US009416475B2

(12) United States Patent
Kulkarni

(10) Patent No.: US 9,416,475 B2
(45) Date of Patent: Aug. 16, 2016

(54) AIR FLOW IN A WASHING MACHINE APPLIANCE

(71) Applicant: General Electric Company, Schenectady, NY (US)

(72) Inventor: Ashutosh Kulkarni, Bangalore (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 620 days.

(21) Appl. No.: 13/850,658

(22) Filed: Mar. 26, 2013

(65) Prior Publication Data

US 2014/0290313 A1 Oct. 2, 2014

(51) Int. Cl.

*D06F 25/00* (2006.01)
*D06F 37/26* (2006.01)
*D06F 23/02* (2006.01)

(52) U.S. Cl.

CPC ..... *D06F 25/00* (2013.01); *D06F 23/02* (2013.01); *D06F 37/267* (2013.01)

(58) Field of Classification Search

CPC ..... D06F 25/00; D06F 23/02; D06F 37/267
See application file for complete search history.

(56) References Cited

U.S. PATENT DOCUMENTS 2,910,854 A * 11/1959 Hughes ..... D06F 25/00 34/596
3,841,117 A * 10/1974 Crivilles ..... D06F 39/14 34/596
4,112,590 A * 9/1978 Muller ..... D06F 58/24 34/596
6,832,441 B2 12/2004 Jeong et al.
7,421,865 B2 9/2008 Lee et al.
7,707,860 B2 5/2010 Hong et al.
2005/0066538 A1* 3/2005 Goldberg ..... D06F 25/00 34/218
2006/0086001 A1* 4/2006 Jeong ..... D06F 25/00 34/606
2006/0096335 A1* 5/2006 Park ..... D06F 25/00 68/20
2006/0123854 A1* 6/2006 Hong ..... D06F 25/00 68/19.1
2009/0255146 A1* 10/2009 Klug ..... D06F 25/00 34/491
2011/0048078 A1* 3/2011 Tobi ..... D06F 35/001 68/12.13
2011/0277513 A1 11/2011 Oak et al.
2013/0104607 A1* 5/2013 Broitzman ..... D06F 29/00 68/13 R

FOREIGN PATENT DOCUMENTS

EP 2 386 674 A2 11/2011
GB 973473 10/1964
JP 2005052682 A 3/2005

* cited by examiner

*Primary Examiner* — Joseph L Perrin
(74) *Attorney, Agent, or Firm* — Dority & Manning, P.A.

(57) ABSTRACT

A washing machine appliance is provided having one or more features to improve the airflow in the washing machine appliance during a spin cycle and/or an overnight drying cycle. The appliance uses one or more one way valves in an inlet duct and/or an exhaust duct to direct the airflow through the washing machine appliance during spin cycles. Additionally, or alternatively, the appliance provides ambient air through an inlet port positioned proximate to an opening in a wash drum and exhausts the air to the ambient through an exhaust port positioned at a rear end of a wash tub.

20 Claims, 8 Drawing Sheets

AIR FLOW IN A WASHING MACHINE APPLIANCE

FIELD OF THE INVENTION

The subject matter of the present disclosure relates generally to the airflow through a washing machine appliance.

BACKGROUND OF THE INVENTION

A horizontal washing machine appliance generally includes a cabinet with a wash tub mounted therein. A wash drum can be rotatably mounted within the wash tub and can receive articles for washing through an opening. The wash drum generally includes a plurality of holes so as to allow the flow of a fluid, such as air or wash liquid, between the wash drum and wash tub.

During a wash cycle of the washing machine appliance, wash liquid, e.g., detergent, fabric softener, water, and/or bleach, can fill the wash tub to an appropriate level and be applied to articles within the wash basket. Such wash liquid can assist with cleaning of the articles, e.g., as the articles are agitated during the wash cycle. After the wash cycle, the washing machine appliance can rinse the wash fluid from the articles, e.g., using fresh water. Before and/or after the rinse cycle, the washing machine appliance can initiate one or more spin cycles to remove liquids from the articles. During the spin cycles, the wash drum is rotated at a relatively high RPM within the wash tub to wring liquid from the articles, such that liquid flows out of the articles, through the plurality of holes in the wash drum, and drains out of the wash tub.

Following one or more wash cycles and spin cycles, the washing machine can initiate a drying cycle, also referred to as an overnight drying cycle, so as to provide washed and dried articles to the user without the need for the user to, e.g., stay up later than desired or wake up earlier than desired, to switch the washed clothes to a drier after washing. The combination of a wash and overnight drying cycle can last approximately as long as the expected sleep time of the user, so the dried clothes do not have time to settle within the wash drum and, e.g., develop wrinkles During an overnight drying cycle, the washing machine appliance can dry the articles by rotating the wash drum at a relatively low RPM within the wash tub, while providing airflow to the wash drum to remove moisture from the air and the articles. Generally, air is introduced through an inlet port positioned in the wash tub, flows through the plurality of holes in the wash drum, and then exits through an exhaust port positioned near the opening of the wash drum.

Certain problems can exist with such a construction, however. For example, an appliance of such a construction can have poor air circulation during a spin cycle where air can be bypassed without coming in contact with the articles and can therefore be less efficient at removing moisture from the air and articles. This can result in a relatively high remaining moisture content (RMC) and can make it more difficult to then dry the articles. Additionally, during an overnight drying cycle of an appliance of such a construction, the air tends to be "short-cycled," wherein air flows along the least resistance path from the inlet port to the exhaust port with little or no contact with the articles. More particularly, the articles to be dried tend to collect near a back end of the wash drum, while air tends to enter the wash drum near the opening of the wash drum and flow straight through to the exhaust port. Short-cycling can result in a low amount of contact between the airflow and the articles prior to the air being exhausted from the appliance. This can leave the articles with a relatively high RMC. Further, a washing machine appliance of such a construction can have accumulations of lint near the opening of the wash drum.

Accordingly, a washing machine appliance having one or more features that can reduce the RMC of articles present in the wash drum after a spin cycle and/or after a dry cycle would be useful.

BRIEF DESCRIPTION OF THE INVENTION

The present disclosure provides a washing machine appliance having one or more features to improve the airflow in the washing machine appliance during a spin cycle and/or an overnight drying cycle. The appliance uses one or more one way valves in an inlet duct and/or an exhaust duct to direct the airflow through the washing machine appliance during spin cycles. Additionally, or alternatively, the appliance provides ambient air through an inlet port positioned proximate to an opening in a wash drum and exhausts the air to the ambient through an exhaust port positioned at a rear end of a wash tub. Additional aspects and advantages of the present disclosure will be set forth in part in the following description, or may be apparent from the description, or may be learned through practice of the disclosure.

In one exemplary embodiment of the present disclosure, a washing machine appliance is provided including a wash tub and a wash drum rotatably mounted within the wash tub. The washing machine appliance also includes an inlet duct in fluid communication with the wash drum and the wash tub and configured for providing a flow of air to the wash drum and the wash tub. The washing machine appliance additionally includes a one way inlet valve positioned within the inlet duct and moveable between an open position and a closed position. The one way inlet valve is configured for only allowing air to flow in a direction through the inlet duct into the wash drum and the wash tub. The washing machine appliance further includes a first exhaust duct in fluid communication with the wash drum and the wash tub and configured for exhausting air from the wash drum and the wash tub. Air is caused to enter the appliance through the inlet duct and exist through the first exhaust duct when the wash drum rotates at or above an $RPM_{THR}$.

In another exemplary embodiment of the present disclosure, a washing machine appliance is provided, including a wash tub and a wash drum rotatably mounted within the wash tub. The wash drum defines an opening configured for receiving articles to be washed, dried, or both, a cylindrically shaped wall extending from the opening and defining a length, and a plurality of holes along the cylindrically shaped wall configured for allowing a flow of a fluid between the wash drum and the wash tub. The washing machine appliance additionally includes an inlet port positioned proximate to the opening of the wash drum configured for providing ambient air to the wash drum. Further, the washing machine appliance includes an exhaust port positioned at a rear end of the wash tub configured for exhausting air from the wash tub, such that at least a portion of the air provided through the inlet port travels the length of the cylindrically shaped wall prior to flowing to the wash tub through the plurality of holes.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
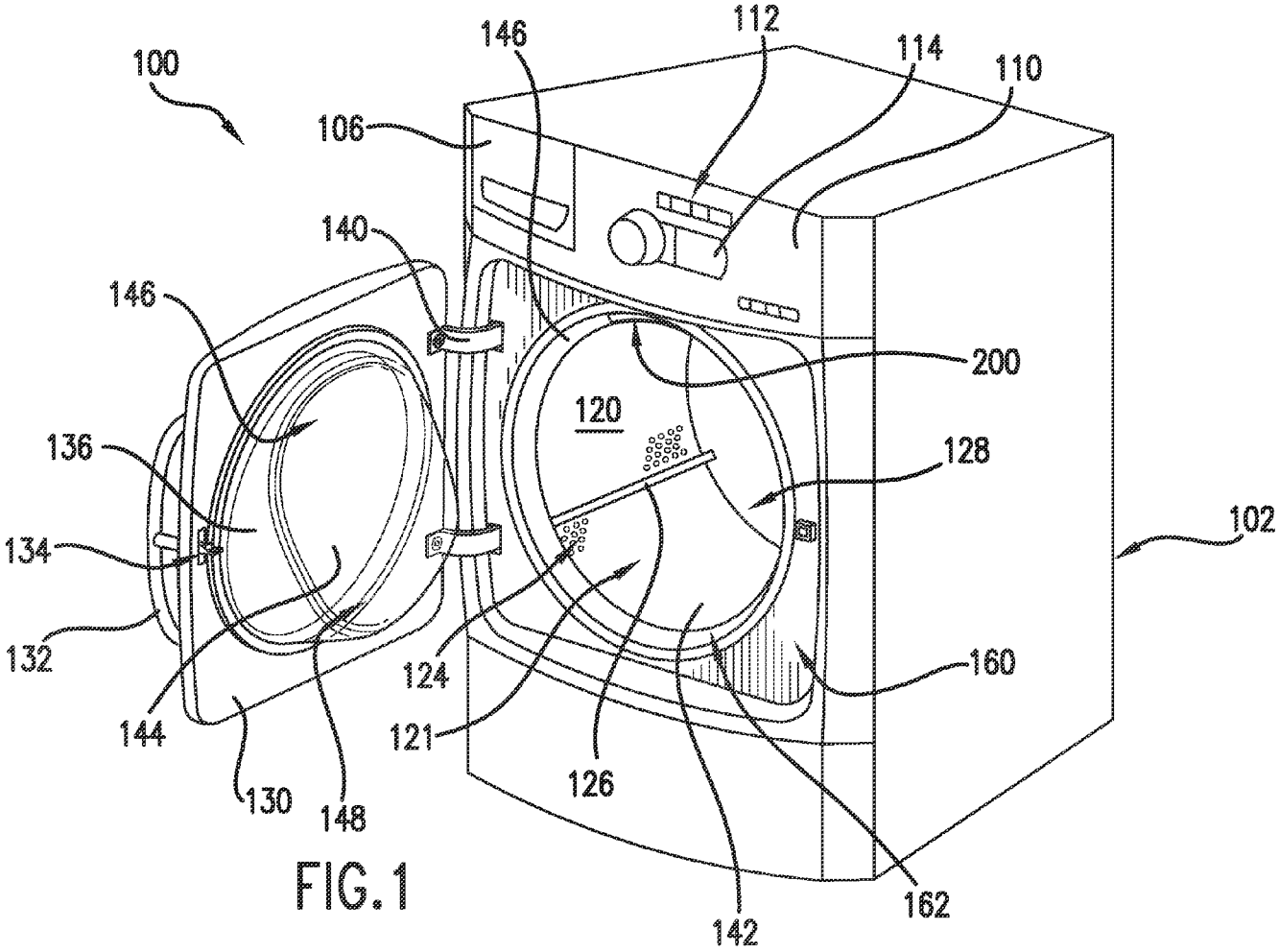
FIG. 1 provides a perspective view of an exemplary embodiment of a washing machine appliance of the present disclosure.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

Figure 2:
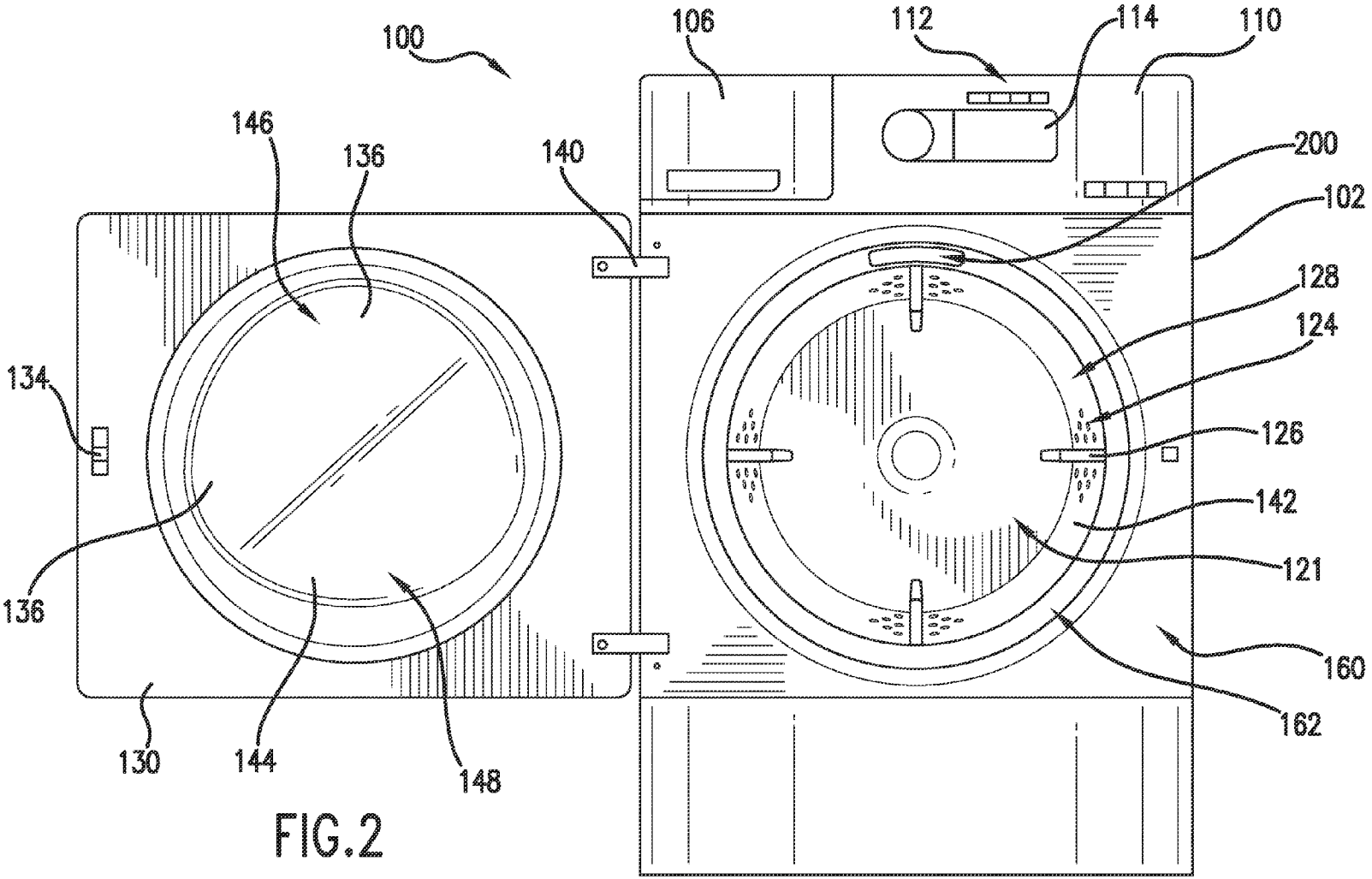
FIG. 2 provides a front view of the washing machine appliance of FIG. 1 with a door shown in an open position.

FIGS. 1 and 2 illustrate an exemplary horizontal axis washing machine appliance 100. However, while described in the context of a specific embodiment of horizontal axis washing machine appliance 100, using the teachings disclosed herein, it will be understood that horizontal axis washing machine appliance 100 is provided by way of example only. Other washing machine appliances having different configurations, different appearances, and/or different features may also be utilized with the present subject matter as well.

Washing machine appliance 100 has a cabinet 102 defining a vertical direction V and a transverse direction T that is orthogonal to vertical direction V. A wash tub 110 is positioned within cabinet 102 (see FIGS. 3 through 8). A wash drum 120 is rotatably mounted in the wash tub 110. A motor (not shown) is in mechanical communication with drum 120 in order to selectively rotate drum 120 (e.g., during an agitation or a rinse cycle of washing machine appliance 100). Drum 120 defines an opening 128 configured for receiving articles to be washed, dried, or both, into a wash chamber 121 defined by wash drum 120. Additionally, drum 120 defines a cylindrically-shaped wall 142 extending in the transverse direction T from opening 128 defining a length L (see FIG. 3). A plurality of holes 124 are positioned along wall 142. The plurality of holes 124 span the length of wall 142 and facilitate a flow between drum 120 and tub 110 of a fluid, such as a wash fluid or air.

A plurality of ribs 126 extend from wall 142 of drum 120 into wash chamber 121. Ribs 126 assist in agitation of articles disposed within wash chamber 121 during operation of washing machine appliance 100. For example, ribs 126 may lift articles disposed in drum 120 during rotation of drum 120. A detergent drawer 106 is slidably mounted within cabinet 102. Detergent drawer 106 receives detergent and directs the detergent to wash chamber 121 during operation of appliance 100.

As shown in FIGS. 1 and 2, cabinet 102 of washing machine appliance 100 has a door casing assembly 160. Door casing assembly 160 defines an opening 162 that permits a user access to opening 128 and wash chamber 121 of drum 120. A door 130 is mounted to door casing assembly 160 by two hinges 140 and is configured to close off openings 162 and 128 of door casing assembly 160 and drum 120, respectively. A window 136 in door 130 permits viewing of wash chamber 121 during operation of appliance 100. Door 130 also includes a handle 132 that, e.g., a user may pull when opening and closing door 130. Latch 134 is configured for selectively securing door 130 in a closed configuration (not shown).

Washing machine appliance 100 also includes a gasket 146 positioned at opening 128 of drum 120 that creates a fluid seal between door 130 and door casing assembly 160 when door 130 is in a closed configuration (i.e., a configuration in which door 130 is positioned adjacent cabinet 102). For the exemplary embodiment of FIGS. 1 and 2, and as will be discussed further with reference to FIGS. 3 through 8, an inlet port 200 is positioned in gasket 146 that provides ambient air to drum 120 during various methods of operation of washing machine appliance 100. Further, door 130 is shaped so as to direct air from inlet port 200 into drum 120. More particularly, door 130 includes a funnel portion 144, wherein the thickness of door 130 increases from a top portion 150 to a bottom portion 148, forming an arcuate cross-sectional shape. Such a configuration allows air to flow more directly into drum 120 from inlet port 200.

It should be appreciated, however, that in other exemplary embodiments of the present disclosure, inlet port 200 may be positioned elsewhere and/or door 130 may have another shape or configuration. For example, in other exemplary embodiments of the present disclosure, inlet port 200 may be positioned in another location proximate opening 128 or may be positioned in wash tub 110, and door 130 may have a curved, straight, or slanted cross-sectional shape.

A control panel 111 with a plurality of input selectors 112 is also mounted to cabinet 102. Control panel 111 and input selectors 112 collectively form a user interface for user selection of machine cycles and features. A display 114 of control panel 111 indicates selected features, a countdown timer, and/or other items of interest to appliance users.

Operation of washing machine appliance 100 is controlled by a controller or processing device (not shown), that is operatively coupled to control panel 111 for user manipulation to select washing machine cycles and features. In response to user manipulation of control panel 111, the controller operates the various components of washing machine appliance 100 to execute selected machine cycles and features.

In an illustrative aspect of the present disclosure, articles or laundry items are loaded into wash chamber 121, and a washing operation is initiated through user manipulation of input selectors 112. A portion of drum 120 is filled with water and detergent to form a wash fluid. One or more valves (not shown) can be controlled by washing machine appliance 100 to provide for filling drum 120 and tub 110 to an appropriate level for the amount of articles being washed. Once drum 120 and tub 110 are properly filled with fluid, the contents of wash chamber 121 are agitated with ribs 126 for cleansing of laundry items in drum 120.

After the agitation phase of the wash cycle is completed, drum 120 and tub 110 are drained. Laundry articles can then be rinsed by again adding fluid such as water to drum 120 and depending on the particulars of the cleaning cycle selected by a user, ribs 126 may again provide agitation within wash chamber 121. The fluid is again drained from drum 120 and tub 110. Appliance 100 also uses one or more spin cycles in order to wring wash fluid from the articles being washed. In particular, a spin cycle may be applied after the wash cycle and/or after the rinse cycle. Following the last spin cycle, washing machine appliance 100 can commence an overnight drying cycle, wherein articles in appliance 100 are dried without the use of a heater.

Figure 3:
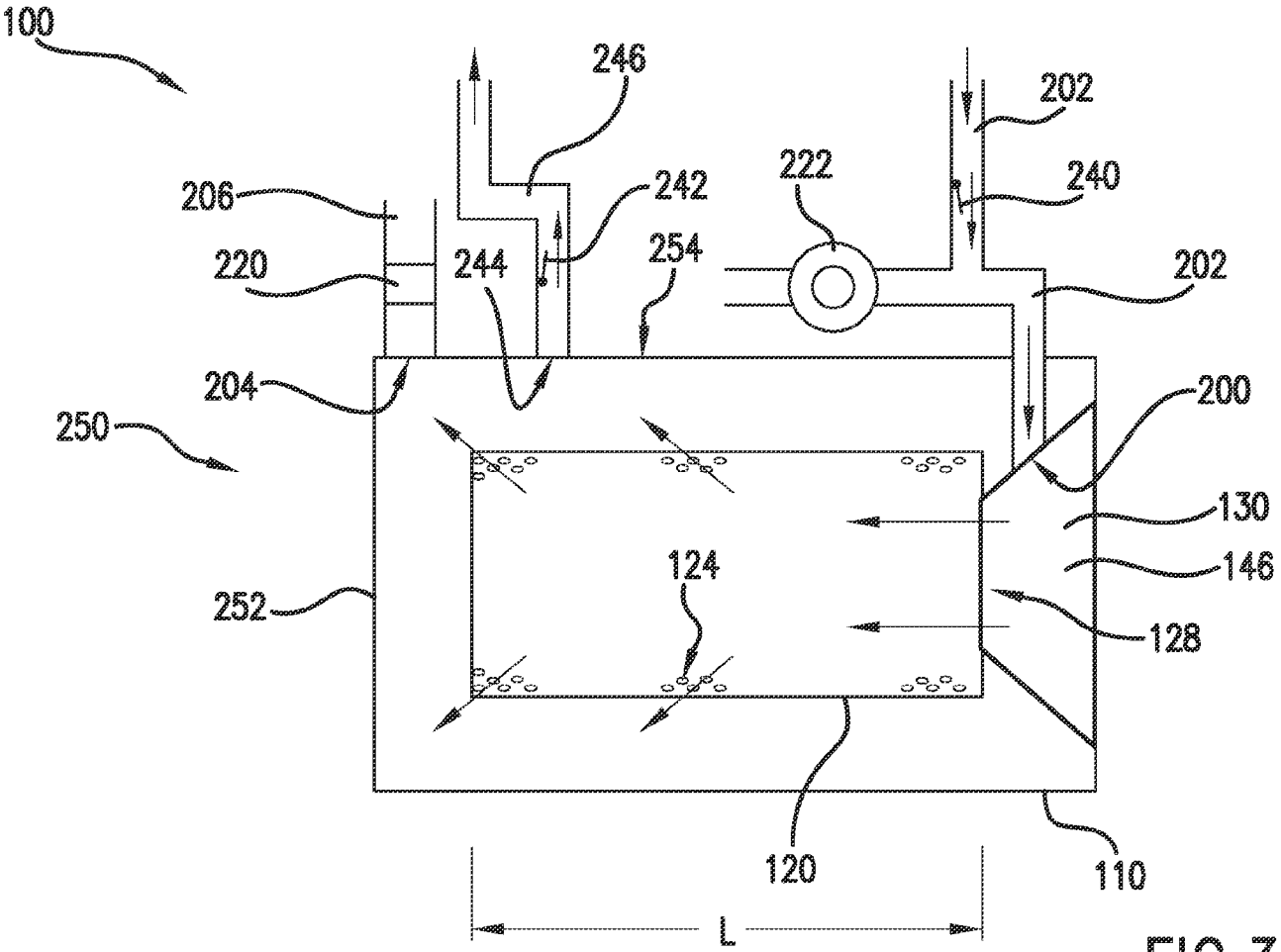
FIG. 3 provides a schematic illustration of an exemplary embodiment of a washing machine appliance of the present disclosure during a spin cycle.
Figure 4:
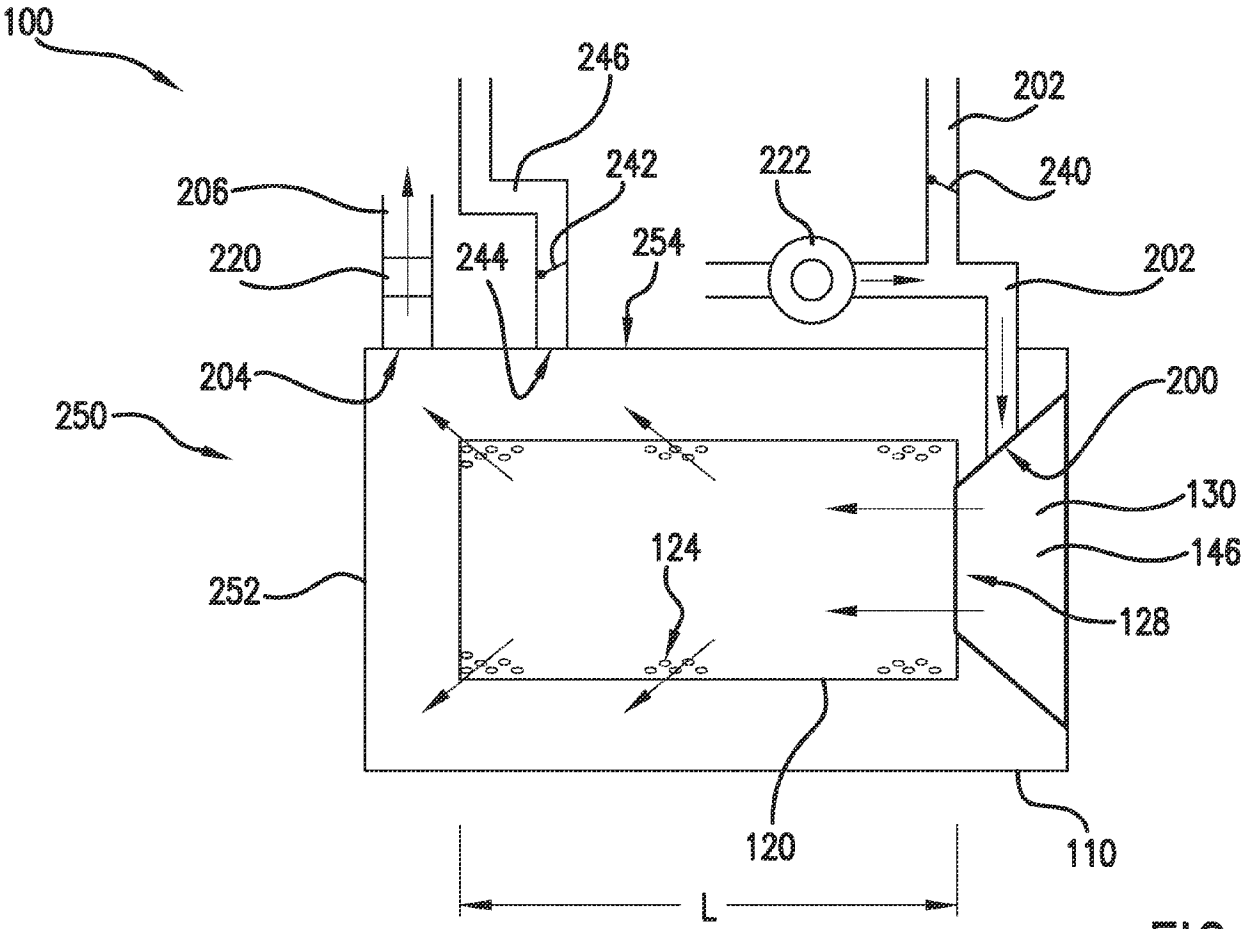
FIG. 4 provides a schematic illustration of the washing machine appliance of FIG. 3 during an overnight drying cycle.
Figure 5:
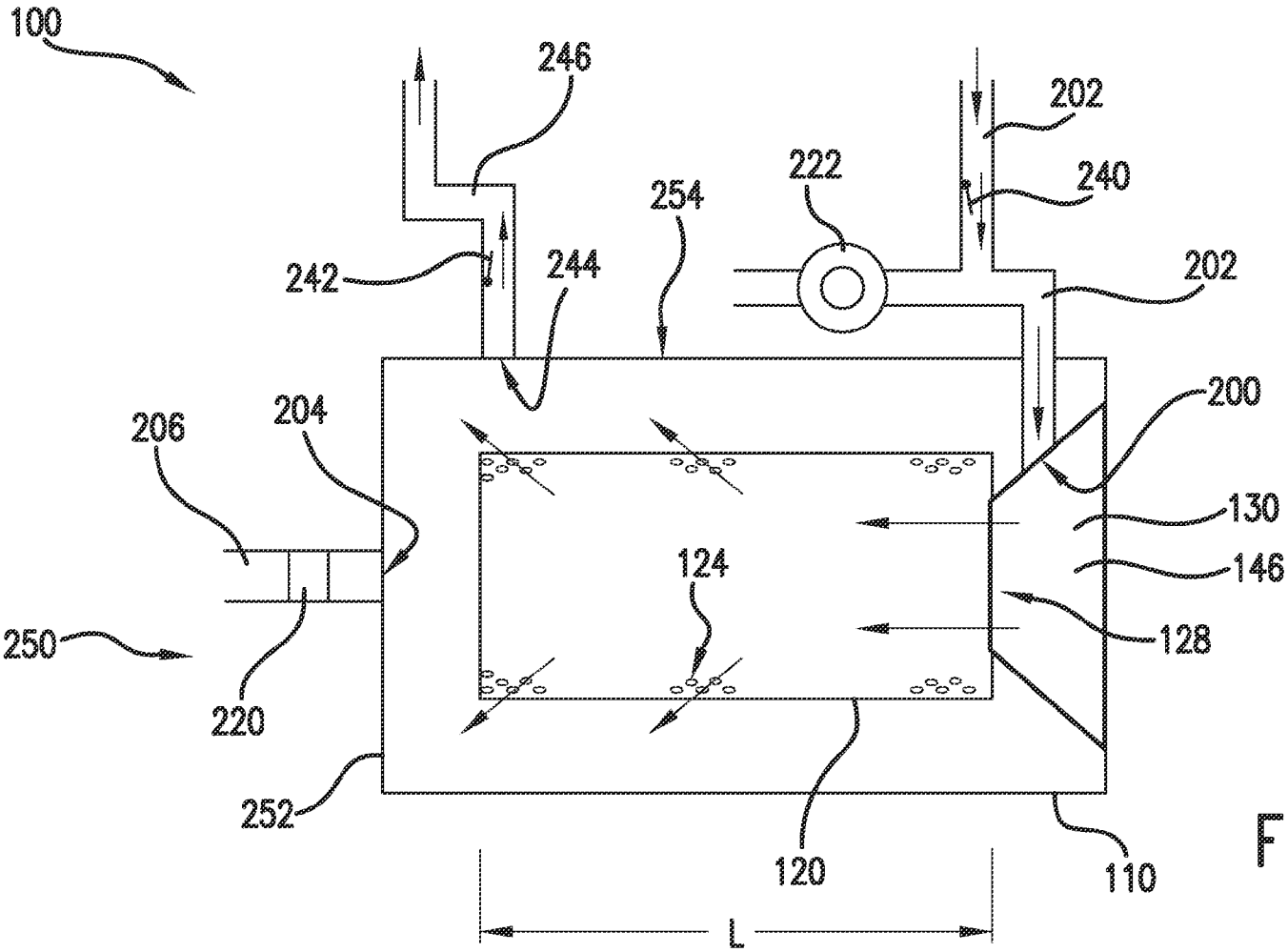
FIG. 5 provides a schematic illustration of another exemplary embodiment of a washing machine appliance of the present disclosure during a spin cycle.
Figure 6:
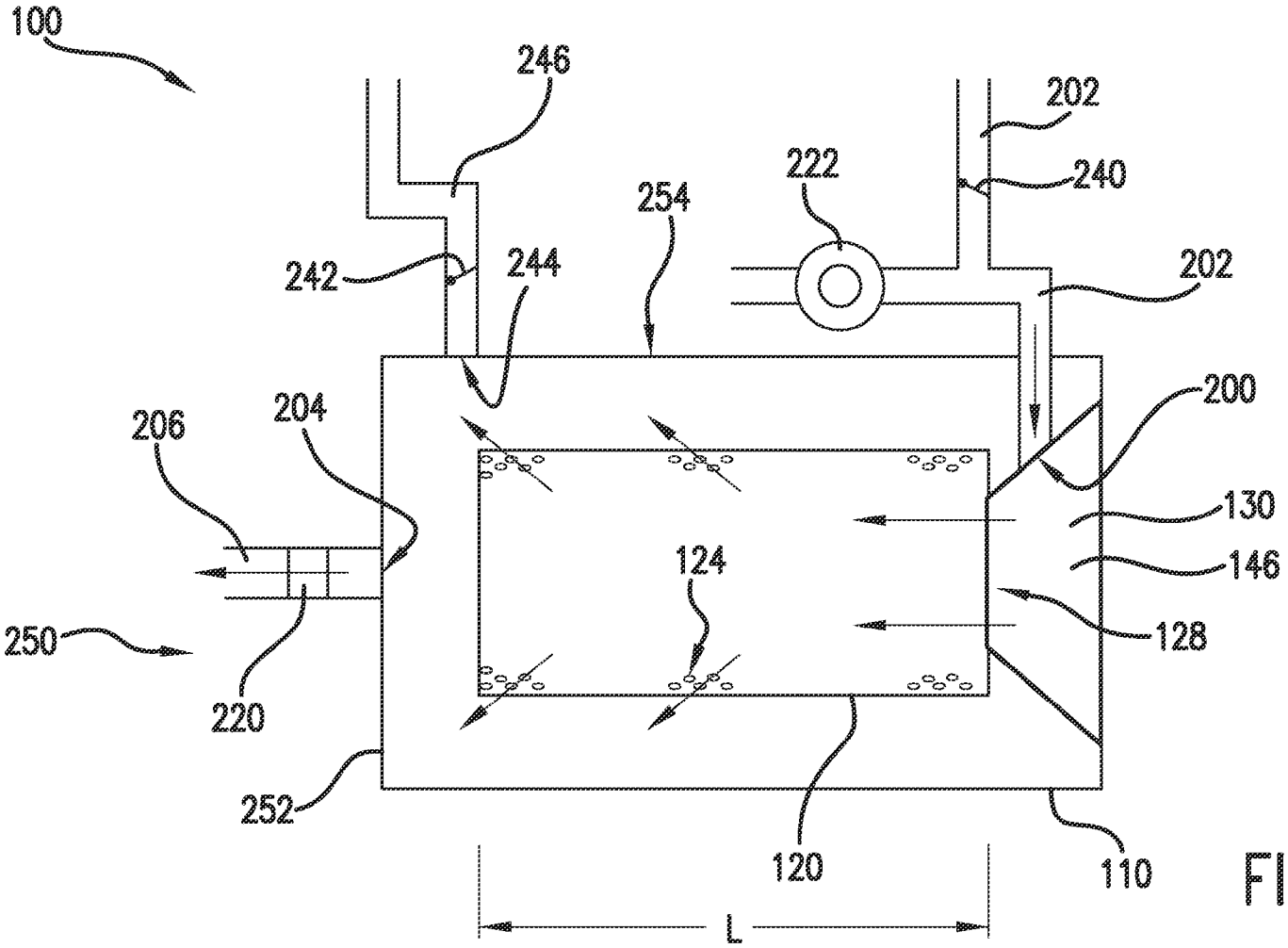
FIG. 6 provides a schematic illustration of the washing machine appliance of FIG. 5 during an overnight drying cycle.
Figure 7:
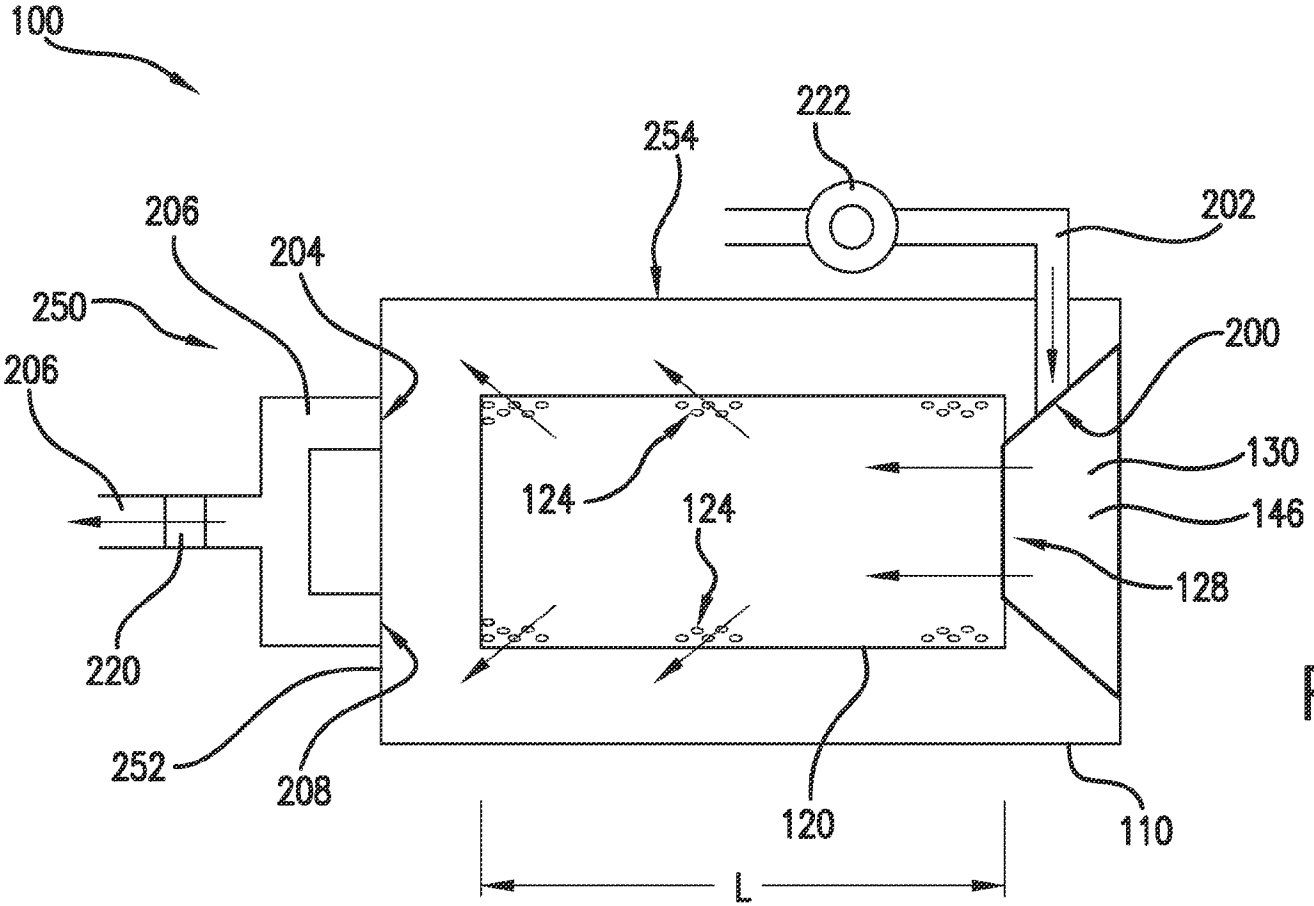
FIGS. 7 and 8 provide schematic illustrations of two additional exemplary embodiments of a washing machine appliance of the present disclosure.
Figure 8:
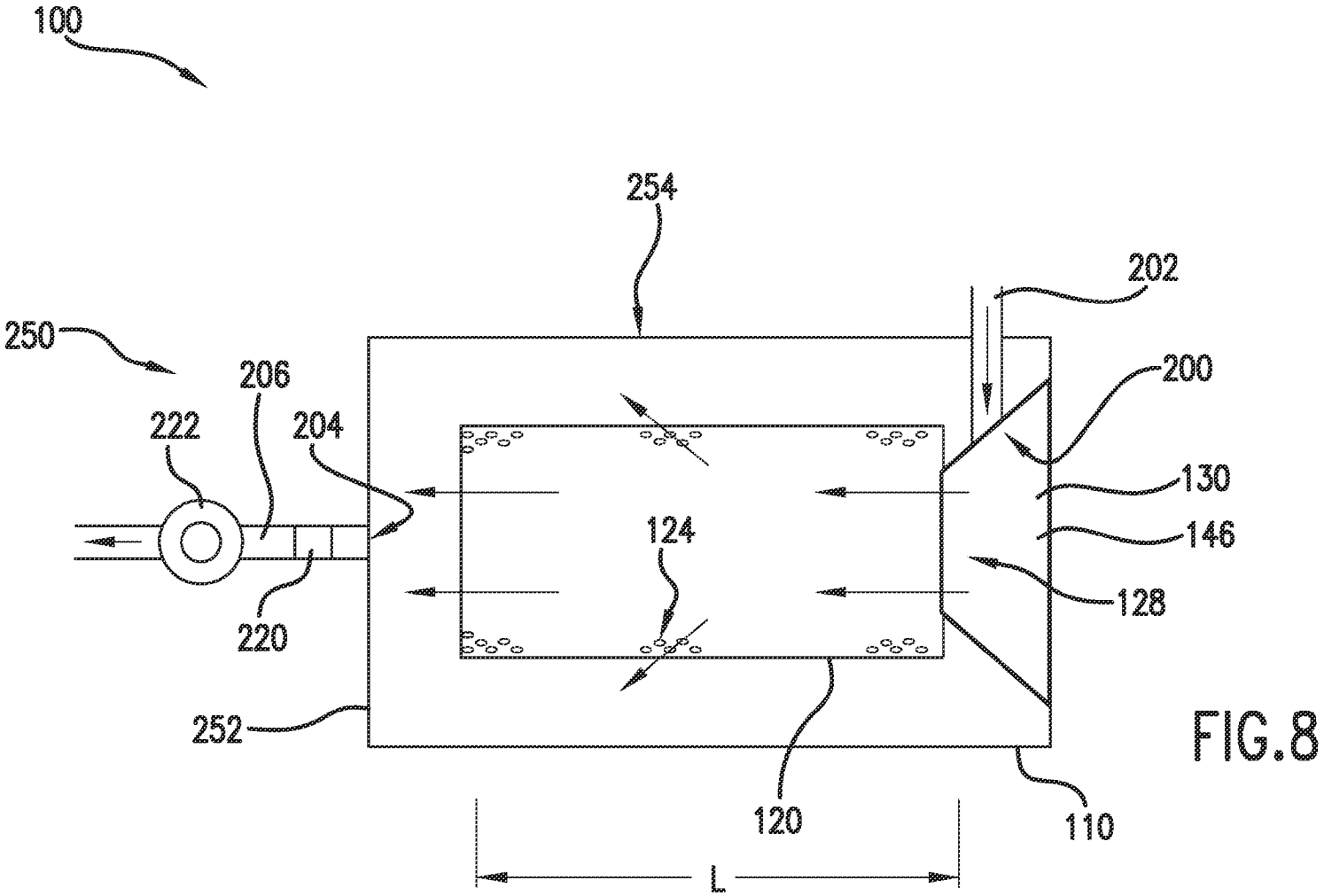

Various exemplary embodiments of the present disclosure are provided in FIGS. 3 through 8, and described below with reference thereto. FIGS. 3 and 4 provide schematic illustrations of one exemplary washing machine appliance during a spin cycle and overnight drying cycle. FIGS. 5 and 6 provide schematic illustrations of another exemplary washing machine appliance also during a spin cycle and overnight drying cycle. FIG. 7 provides a schematic illustration of yet another exemplary washing machine appliance having multiple exhaust ports. FIG. 8 provides a schematic illustration of still another exemplary washing machine appliance having a blower in fluid communication with an exhaust port.

Referring now to FIGS. 3 and 4, schematic illustrations of exemplary washing machine appliance 100 are provided wherein an airflow, A, allows for a reduction in the remaining moisture content (RMC) of articles within wash chamber 121 during a spin cycle and/or a drying cycle such as an overnight drying cycle. FIG. 3 shows schematically the flow of air A through washing machine appliance 100 during an exemplary spin cycle, while FIG. 4 shows schematically the flow of air A through washing machine appliance during an exemplary drying cycle such as an overnight drying cycle.

As shown, appliance 100 further includes an inlet duct 202 in fluid communication with wash drum 120 and wash tub 110 through inlet port 200. Inlet duct 202 is configured to provide a flow of ambient air A to wash tub 110 and wash drum 120 through inlet port 200. A blower 222 is in fluid communication with duct 202 and is selectively operable to provide ambient air to drum 120 through inlet duct 202 and inlet port 200. The ambient air can be provided from any suitable location outside cabinet 102 of washing machine appliance 100.

A one way inlet valve 240 is positioned within inlet duct 202 and is configured to only allow air to flow in a direction through inlet duct 202 into drum 120. More particularly, one way inlet valve 240 is moveable between an open position (see FIG. 3) and a closed position (see FIG. 4). In the open position air may flow through valve 240 and duct 202 into drum 120 and tub 110. In the closed position air may not flow in the reverse direction through valve 240.

A first exhaust duct 246 and a second exhaust duct 206 are provided in fluid communication with wash tub 110 and wash drum 120 through a first exhaust port 244 and second exhaust port 204, respectively. Exhaust ports 204 and 244 are positioned at a rear end 250 of tub 110. More particularly, exhaust ports 204 and 244 are positioned on a top side 254 of tub 110 at rear end 250. First and second exhaust ducts 246, 206 are configured for exhausting air from wash tub 110 and wash drum 120 to the ambient air at any suitable location outside cabinet 102 of appliance 100.

First exhaust duct 246 is in fluid communication with exhaust port 244, and has a one way exhaust valve 242 positioned therein. Valve 242 is configured to only allow air to flow in a direction from wash tub 110 and wash drum 120 out through exhaust duct 246. More particularly, one way exhaust valve 242 is moveable between an open position (see FIG. 3) and a closed position (see FIG. 4). In the open position air may flow from tub 110 out through exhaust duct 246 and valve 242 to the ambient air. In the closed position air may not flow in the reverse direction through valve 242 or exhaust duct 246.

One way inlet valve 240 and one way exhaust valve 242 can each be spring loaded flap valves configured to open and close based on a differential pressure between a portion of each respective duct 202, 246 upstream and downstream of the respective valve 240, 242. It should be appreciated, however, that other mechanical or electro-mechanical one way valves may be used as well. For example, valves 240 and 242 may be electro-mechanical valves actuated by the controller between an open position and a closed position based on a particular operating method of appliance 100. It should also be appreciated that in other exemplary embodiments of the present disclosure, appliance 100 may only include a single one way valve positioned in either inlet duct 202 or exhaust duct 246.

Second exhaust duct 206 is in fluid communication with exhaust port 204 and is configured for exhausting air to the ambient air. A lint filter 220 is positioned within exhaust duct 206. By way of example, lint filter 220 can be a fine mesh. However, in other exemplary embodiments, lint filter 220 can have any other suitable configuration.

Notably, the exhaust ports 204, 244 are positioned such that when wash fluid is filled to an appropriate level in tub 110 and drum 120 e.g., during wash or rinse cycles, wash fluid does not travel through any of the exhaust ports to the exhaust ducts 206, 246. More specifically, the exhaust ports 204, 244 may be positioned vertically above a level that wash fluid may fill tub 110 and drum 120 e.g., during wash or rinse cycles.

Referring specifically to FIG. 3, during a spin cycle, drum 120 is rotated at a relatively high revolutions per minute (RPM) so as to urge fluid from the articles in drum 120, through the plurality of holes 124, into tub 110, and out one or more drains (not shown). More particularly, drum 120 rotates at an RPM greater than or equal to a threshold RPM ($RPM_{THR}$) during the one or more spin cycles. By way of example, $RPM_{THR}$ can be in the range of about 200 to 1500. Alternatively, $RPM_{THR}$ can be in the range of about 250 to 1450. In still another exemplary embodiment, $RPM_{THR}$ can be about 300 rpm. When drum 120 rotates at an RPM great than or equal to $RPM_{THR}$, valves 240 and 242 are configured to open and cause air to enter the appliance through inlet duct 202 and exit through the first exhaust duct 246. More particularly, when drum 120 rotates at an RPM great than or equal to $RPM_{THR}$, centrifugal forces generated within drum 120 force air out through the plurality of holes in drum 120, increasing the pressure in tub 110. This creates a high enough differential pressure between a portion of exhaust duct 246 upstream of valve 242 and a portion of exhaust duct 246 downstream of valve 242, such that valve 242 opens and allows an airflow A from tub 110 out through exhaust duct 246. Likewise, when drum 120 rotates at such an RPM, the differential air pressure between a portion of inlet duct 202 downstream of valve 240 and a portion of inlet duct 202 upstream of valve 240 is sufficient to force valve 240 to the open position, allowing an airflow A through inlet duct 202 into drum 120.

As is shown schematically in FIG. 3, the use of one way valves 240, 242 allows washing machine appliance 100 to direct the airflow A during a spin cycle from inlet port 200, into drum 120, through the plurality of holes 124 into tub 110, and out through exhaust port 244. Appliance 100 having such a configuration may be able to more efficiently remove moisture from the articles in drum 120 during a spin cycle. Thus, the RMC of the articles in drum 120 following a spin cycle may be reduced by e.g., approximately 3% to 5%, as compared to a washing machine appliance that does not direct the flow of ambient air through drum 120 during a spin cycle. The reduced RMC of the articles in drum 120 following a spin cycle can make it easier to subsequently dry the articles.

Referring now to FIG. 4, during an overnight drying cycle, articles in appliance 100 are dried without the use of a heater. Additionally, drum 120 rotates at a speed less than $RPM_{THR}$, such that the differential pressures in ducts 202 and 246 are not sufficient to open valves 240 and 242, respectively. As indicated, during the overnight drying cycle, blower 222 is activated to provide an airflow A of ambient air to duct 202 and drum 120 through inlet port 200. Blower 222 can be configured to run continuously throughout the overnight drying cycle. Alternatively, blower 222 can be configured to run intermittently during overnight drying cycles, depending on e.g., a fixed schedule or a varying schedule that accounts for the RMC of the articles in drum 120.

The ambient air enters drum 120 through inlet port 200 positioned proximate to opening 128 and flows to tub 110 through the plurality of holes 124. The air in tub 110 then exhausts through exhaust port 204 positioned at the rear end 250 of tub 110. As indicated in FIG. 4, at least a portion of the airflow A provided to drum 120 through inlet port 200 is encouraged to travel the length L of drum 120 prior to flowing into tub 110. This is due to the positioning of exhaust port 204 at the rear end 250 of tub 110. At least a portion of the airflow A provided by inlet port 200 therefore is in contact with the articles to be dried for a relatively extended period of time prior to exiting drum 120, which may lower the RMC of the articles during the overnight drying cycle more efficiently.

During the overnight drying cycle, particles of the laundry items being dried tend to separate from the laundry items and be carried away with the air, creating lint. As such, lint filter 220 is provided in exhaust duct 206. Lint filter 220 is configured for catching and collecting the particles that separate from the laundry items being dried during the overnight drying cycle.

As is shown schematically in FIGS. 3 and 4, during a spin cycle a majority of the airflow A from tub 110 exhausts through duct 246 as opposed to duct 206 (FIG. 3). This is due to the fact that once valve 242 is opened, there is less resistance through duct 246 as compared to duct 206 due to the presence of lint filter 220. During an overnight drying cycle, however, when the differential pressure is not sufficient to open valve 242, the airflow A is forced to travel through duct 206, and accordingly through lint filter 220 (FIG. 4). This allows washing machine appliance 100 to bypass the resistance of lint filter 220 during spin cycles, while avoiding bypass of lint filter 220 during overnight drying cycles (when most lint is created).

Referring now to FIGS. 5 and 6, schematic illustrations of another exemplary embodiment of the present disclosure are provided, showing a spin cycle and an overnight drying cycle, respectively. Operation of the exemplary washing machine 100 provided in FIGS. 5 and 6 is similar to the operation of the exemplary washing machine provided in FIGS. 3 and 4. By contrast, however, exemplary washing machine 100 shown schematically in FIGS. 5 and 6 has second exhaust port 204 positioned on a rear wall 252 of wash tub 110, with second exhaust duct 206 in fluid communication therewith.

As shown in FIG. 5, during a spin cycle, valves 240 and 242 positioned in inlet duct 202 and exhaust duct 246, respectively, are in the open position, such that the airflow A travels from inlet port 200, to drum 120, into tub 110 and out through exhaust port 244. FIG. 6 then shows schematically the flow of air A during an overnight drying cycle. During such a cycle, blower 222 provides an airflow A through inlet port 200, into drum 120 and tub 110, and out though second exhaust port 204 positioned in rear wall 252, as opposed to top side 254 of tub 110. The airflow A through second exhaust port 204 passes through second exhaust duct 206 and lint filter 220.

FIG. 7 provides another exemplary embodiment of washing machine appliance 100 during an overnight drying cycle. Exemplary washing machine appliance 100 shown schematically by FIG. 7 operates similarly during an overnight drying cycle to the exemplary washing machine appliance provided in FIGS. 4 and 6. However, the exemplary washing machine 100 provided in FIG. 7 comprises an additional exhaust port 208 positioned in rear wall 252 of tub 110. Exhaust port 208 and exhaust port 204 are each in fluid communication with exhaust duct 206, such that the airflow A through exhaust ports 204 and 208 flows through a single lint filter 220.

It should be appreciated, however, that in other exemplary embodiments of the present disclosure the exhaust ports may have any other suitable configuration for urging at least a portion of the airflow A to travel the length of wash drum 120 prior to flowing through holes 124 to wash tub 110. For example, in alternative embodiments of the present disclosure, washing machine appliance may have three or more exhaust ports positioned in rear wall 252 of tub 110, top side 254 of tub 110, or a combination thereof Referring now to FIG. 8, a schematic illustration of still another exemplary embodiment of washing machine appliance 100 is provided during an overnight drying cycle. Exemplary washing machine appliance 100 of FIG. 8 operates similarly during an overnight drying cycle to the other exemplary washing machine appliances discussed above. However, for the exemplary embodiment of FIG. 8, blower 222 is in fluid communication with exhaust duct 206 such that it is configured to provide an airflow A through wash drum 120 and wash tub 110 by moving air through exhaust port 204 and exhaust duct 206.

It should be appreciated that in other exemplary embodiments of the present disclosure, washing machine appliance 100 may include one or more features that improve the airflow during spin cycles, but may not include one or more features to improve the airflow during overnight drying cycles. For example, inlet port 200 may not be positioned proximate to opening 128 and/or appliance 100 may not exhaust air from tub 110 through exhaust ports 204 or 244 positioned at rear end 250 of tub 110. Alternatively, in other exemplary embodiments of the present disclosure, washing machine appliance 100 may include one or more features that improve the airflow during overnight drying cycles, but may not include one or more features that improve the airflow during spin cycles. More specifically, appliance 100 of the present disclosure may not include one or both one way valves 240 and 242 in ducts 202 and 246, respectively (see FIGS. 7 and 8).

This written description uses examples to disclose the invention, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a wash tub;

a wash drum rotatably mounted within said wash tub;

an inlet duct in fluid communication with said wash drum and said wash tub and configured for providing a flow of air to said wash drum and said wash tub;

a one way inlet valve positioned within said inlet duct and moveable between an open position and a closed position, said one way inlet valve configured for only allowing air to flow in a direction through said inlet duct into said wash drum and said wash tub; and a first exhaust duct in fluid communication with said wash drum and said wash tub and configured for exhausting air from said wash drum and said wash tub;

a one way exhaust valve positioned within said first exhaust duct and moveable between an open and a closed position, said one way exhaust valve configured for only allowing air to flow in a direction from said wash tub and said wash drum out through said first exhaust duct;

wherein said wash drum rotates at or above an $RPM_{THR}$ during a spin cycle of the washing machine appliance, and wherein the one way inlet valve and the one way outlet valve are each configured to move to the open positions when said wash drum rotates at or above the $RPM_{THR}$ due to an increased pressure generated in said wash tub.

2. A washing machine appliance as in claim 1, wherein said inlet duct provides ambient air to said wash drum and said wash tub and said first exhaust duct exhausts air to ambient air.

3. A washing machine appliance as in claim 1, wherein said wash drum defines an opening for the receipt of articles to be cleaned, and wherein the appliance further comprises:

an inlet port positioned at the opening of said wash tub, said inlet port in fluid communication with said inlet duct.

4. A washing machine appliance as in claim 3, wherein said first exhaust port is positioned at a rear end of said wash tub.

5. A washing machine appliance as in claim 4, further comprising:

a second exhaust port positioned in said wash tub;

a second exhaust duct in fluid communication with said second exhaust port; and a lint filter positioned in said second exhaust duct.

6. A washing machine appliance as in claim 5, further comprising a blower, wherein said blower is in fluid communication with one of said air inlet duct or said second air exhaust duct.

7. A washing machine appliance as in claim 6, wherein said blower is configured to operate when said wash drum rotates at an RPM less than $RPM_{THR}$.

8. A washing machine appliance as in claim 1, wherein said wash drum defines an opening for the receipt of articles to be cleaned, and wherein the appliance further comprises as gasket positioned at the opening of said wash drum.

9. A washing machine appliance as in claim 1, further comprising a blower, wherein said inlet duct defines an air flowpath from an ambient location to said wash drum and said wash tub independent of the blower, and wherein said first exhaust duct defines an air flowpath from an ambient location to said wash drum and said wash tub independent of the blower.

10. A washing machine appliance as in claim 1, wherein said wash drum rotates below the $RPM_{THR}$ during an overnight dry cycle, and wherein the one way inlet valve and the one way outlet valve are each configured to move to the closed positions when said wash drum rotates below the $RPM_{THR}$.

11. A washing machine appliance, comprising:

a wash tub;

a wash drum rotatably mounted within said wash tub, said wash drum defining an opening configured for receiving articles to be washed, dried, or both;

a cylindrically shaped wall extending from said opening and defining a length; and a plurality of holes along said cylindrically shaped wall configured for allowing a flow of a fluid between said wash drum and said wash tub;

an inlet duct in fluid communication with an inlet port, said inlet port positioned proximate to the opening of said wash drum configured for providing ambient air to said wash drum;

a one way inlet valve positioned within said inlet duct and moveable between an open position and a closed position, said one way inlet valve configured for only allowing air to flow in a direction through said inlet duct into said wash drum and said wash tub;

an exhaust duct in fluid communication with an exhaust port, said exhaust port positioned at a rear end of said wash tub configured for exhausting air from said wash tub, such that at least a portion of the air provided through said inlet port travels the length of said cylindrically shaped wall prior to flowing to said wash tub through said plurality of holes;

a one way exhaust valve positioned within said first exhaust duct and moveable between an open and a closed position, said one way exhaust valve configured for only allowing air to flow in a direction from said wash tub and said wash drum out through said first exhaust duct wherein said wash drum rotates at or above an $RPM_{THR}$ cycle of the washing machine appliance, and wherein the one way inlet valve and the one way outlet valve are each configured to move to the open positions when said wash drum rotates at or above the $RPM_{THR}$ due to an increased pressure generated in said wash tub.

12. A washing machine appliance as in claim 11, further comprising a gasket positioned at the opening of said wash drum.

13. A washing machine appliance as in claim 11, further comprising a door configured for closing off the opening of said wash drum, wherein said door has a arcuate cross-sectional shaped so as to direct air from said inlet port into said wash drum.

14. A washing machine appliance as in claim 11, further comprising a blower in fluid communication with said inlet port, said exhaust port, or both, wherein said blower is configured for causing an airflow from said inlet port, through said wash drum, to said wash tub, and out through said air exhaust port.

15. A washing machine appliance as in claim 11, further comprising:

a lint filter positioned in said exhaust duct.

16. A washing machine appliance as in claim 11, wherein said exhaust port is positioned on a rear wall of said wash tub.

17. A washing machine appliance as in claim 11, wherein said exhaust port comprises two or more exhaust ports positioned on the rear wall of said wash tub, each exhaust port being in fluid communication with said exhaust duct.

18. A washing machine appliance as in claim 11, wherein the exhaust port is positioned on a top side of said wash tub at the rear end of said wash tub.

19. A washing machine appliance as in claim 11, wherein the washing machine appliance is configured for drying washed clothes without an air heater.

20. A washing machine appliance as in claim 11, wherein the washing machine appliance defines a vertical direction and wherein said exhaust port is positioned vertically above a level that a wash fluid fills said wash tub during a wash cycle.

* * * * *